US011679468B2

(12) United States Patent
Tien

(10) Patent No.: US 11,679,468 B2
(45) Date of Patent: Jun. 20, 2023

(54) CHEMICAL-MECHANICAL POLISHING SYSTEM AND METHOD

(71) Applicant: TAIWAN SEMICONDUCTOR MANUFACTURING CO., LTD., Hsinchu (TW)

(72) Inventor: Chia-Ying Tien, Taipei (TW)

(73) Assignee: TAIWAN SEMICONDUCTOR MANUFACTURING CO., LTD., Hsinchu (TW)

( * ) Notice: Subject to any disclaimer, the term of this patent is extended or adjusted under 35 U.S.C. 154(b) by 1070 days.

(21) Appl. No.: 16/414,588

(22) Filed: May 16, 2019

(65) Prior Publication Data

US 2020/0361053 A1 Nov. 19, 2020

(51) Int. Cl.
*B24B 37/04* (2012.01)
*B24B 37/20* (2012.01)

(52) U.S. Cl.
CPC ..... *B24B 37/042* (2013.01); *B24B 37/20* (2013.01)

(58) Field of Classification Search
CPC ..... B24B 55/02; B24B 7/228; B24B 37/005; B24B 37/015; B24B 37/04; B24B 37/042; B24B 37/34
See application file for complete search history.

(56) References Cited

U.S. PATENT DOCUMENTS 5,816,900 A * 10/1998 Nagahara ..... B24B 57/02 451/60
6,227,950 B1 * 5/2001 Hempel ..... B24B 37/345 451/388
8,128,461 B1 * 3/2012 O'Moore ..... B24B 57/02 451/60
9,211,629 B2 * 12/2015 Kawahara ..... B24B 49/08
2002/0137435 A1 * 9/2002 Hu ..... B24D 7/10 451/36
2002/0173232 A1 * 11/2002 Laursen ..... B24B 37/16 451/8
2014/0220864 A1 * 8/2014 Kawahara ..... B24B 49/08 451/24
2016/0346902 A1 * 12/2016 Toyomura ..... B24B 57/02
2020/0009702 A1 * 1/2020 Cheng ..... B08B 1/04
2021/0008681 A1 * 1/2021 Sasaki ..... B24B 7/241

* cited by examiner

*Primary Examiner* — Joel D Crandall
(74) *Attorney, Agent, or Firm* — Maschoff Brennan

(57) ABSTRACT

A chemical-mechanical polishing method includes placing a wafer onto a top side of a polish pad disposed on a platen; introducing a slurry through at least one first hole of the platen to the top side of the polish pad; polishing the wafer with the top side of the polish pad; introducing a gas through a second hole of the platen to the top side of the polish pad after polishing the wafer, wherein an opening diameter of the at least one first hole is greater than an opening diameter of the second hole; and moving the wafer away from the polish pad while introducing the gas is being performed.

20 Claims, 14 Drawing Sheets

CHEMICAL-MECHANICAL POLISHING SYSTEM AND METHOD

BACKGROUND

In the fabrication of semiconductor devices, a variety of semiconductor processing equipment and tools are utilized. One of these processing tools is used for polishing thin, flat semiconductor wafers to obtain a planarized surface. A planarized surface is highly desirable on layers used in both memory and logic devices. The planarization process is important since it enables the subsequent use of a high-resolution lithographic process to fabricate the next-level circuit. The accuracy of a high-resolution lithographic process can be achieved when the process is carried out on a substantially flat surface. The planarization process is therefore an important processing step in the fabrication of semiconductor devices.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1A:
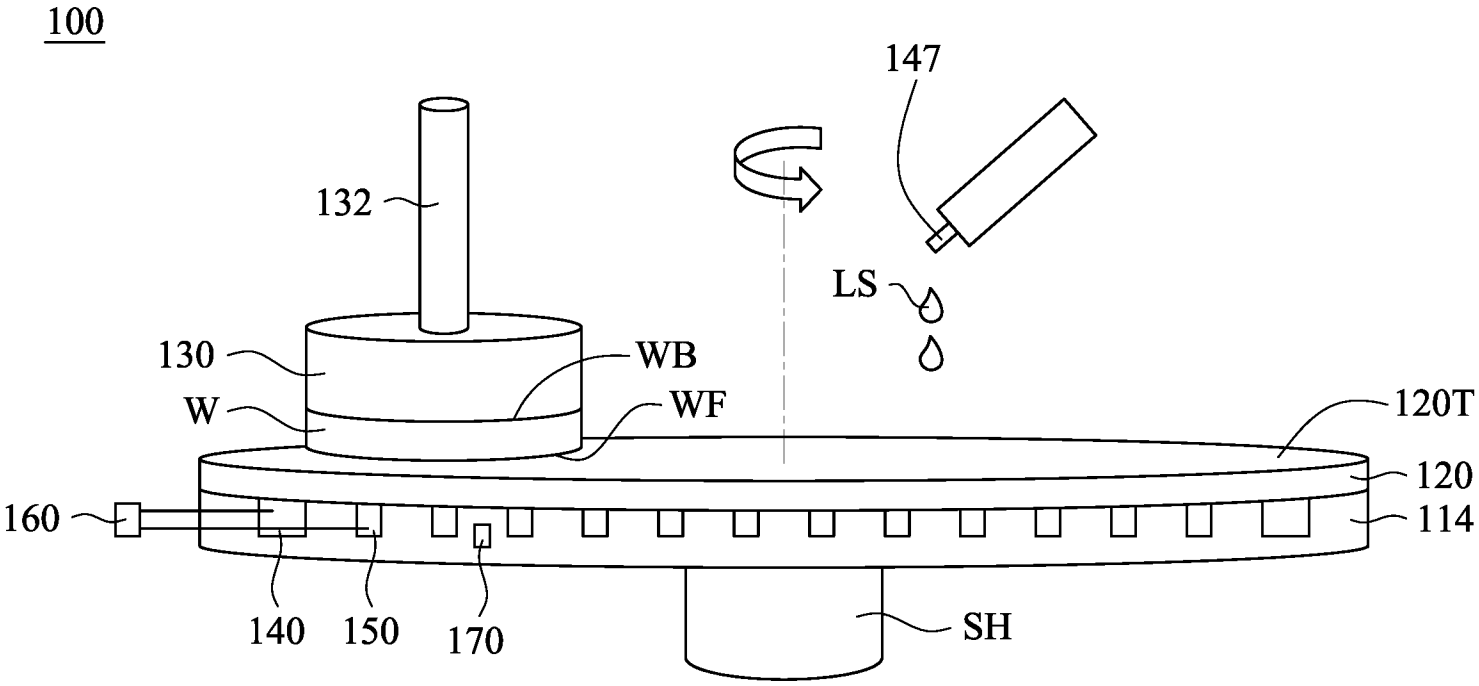
FIG. 1A is a schematic view of a chemical-mechanical polishing (CMP) apparatus according to some embodiments of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

A planarization process can be carried out by chemical mechanical polishing (CMP). The process can be used on a shadow trench isolation (STI) layer, an inter-layer dielectric (ILD) or on an inter-metal dielectric (IMD) layer in fabricating modern semiconductor devices. A CMP process is used primarily for polishing the front surface or the device surface of a semiconductor wafer for achieving planarization and for preparation of the next level processing. CMP polishing results from a combination of chemical and mechanical effects. A possible mechanism for the CMP process involves the formation of a chemically altered layer at the surface of the material being polished. The layer is mechanically removed from the underlying bulk material. An altered layer is then regrown on the surface while the process is repeated again. For instance, in metal polishing, a metal oxide may be formed and removed repeatedly. A wafer is planarized one or more times during a fabrication process in order for the top surface of the wafer to be as flat as possible.

FIG. 1A is a schematic view of a chemical-mechanical polishing (CMP) apparatus 100 according to some embodiments of the present disclosure. The CMP apparatus 100 is utilized for polishing a semiconductor wafer W, i.e. a silicon wafer for removing a film layer from the wafer surface. For instance, the film layer to be removed may include insulating materials such as silicon oxide, silicon nitrite or spin-on-glass material or a metal layer such as aluminum, copper or tungsten. Various other materials such as metal alloys or semiconductor materials such as polysilicon may also be removed.

The CMP apparatus 100 includes a platen 114, a polish pad 120, a polish head 130, a liquid supply system 140, a gas supply system 150, a controller 160, and an endpoint module 170. The polish pad 120 is attached on the platen 114 by suitable adhesive and has a frictional surface 120T.

The wafer W is secured upside down to the polishing head 130, and can be polished by being pressed face down on the polishing pad 120 covered with a slurry. For example, the slurry includes fumed, colloidal silica, aluminum, or $CeO_2$. Either the polishing pad 120 or the polishing head 130 is moved or rotated which oscillates the wafer W over the frictional surface 120T. For example, the polish pad 120 is rotated along with a shaft SH supporting the platen 114. The polishing head 130 is forced downwardly onto the frictional surface 120T by a pressurized air system or similar arrangement. The downward force pressing the polishing head 130 against the frictional surface 120T can be adjusted as desired. In some embodiments, the polishing head 130 is mounted on an elongated pivoting carrier arm 132, which can move the head between several operative positions. With the movement of the carrier arm 132, the polish head 130 may push the wafer W against the frictional surface 120T of the polish pad 120 when performing a CMP process on the wafer W. For example, the carrier arm 132 moves downwards to position a wafer mounted on the head 130 in contact with the polishing pad with suitable CMP pressure. In order to remove the wafer W from contact with the frictional surface 120T (which may be referred to as wafer dechunking), the carrier arm 132 moves upwardly to lift the head 130 and wafer W from the frictional surface 120T. In some examples, a vacuum system is used to secure the wafer W to the polishing head 130. The polishing head 130 is thus sometimes referred to as a chuck. In some embodiments, the platen 114 may be driven by a motor (not shown) to move the polish pad 120 against the wafer W, thus the wafer W is polished by the polish pad 120.

The liquid supply system 140 is at least partially in the platen 114 for providing at least one liquid (e.g., slurry, chemical agent, or water) to the polish pad 120. The liquid may include the aforementioned slurry in some embodiments. In some embodiments, the liquid may include chemical agent or water for cleaning the CMP apparatus 100. The gas supply system 150 is at least partially in the platen 114 for introducing gases between the polish pad 120 and the wafer W, in which the gases are a substance in a form like air that is neither solid nor liquid. The liquid supply system 140 and the gas supply system 150 are connected to the controller 160 for controlling the liquid flow and the gas flow.

The carrier arm 132 may exert a force on the head 130 holding the wafer W, thereby controlling a pressure between the wafer W and the polishing pad 120 during CMP process and wafer dechunking. In some embodiments of the present embodiments, a liquid and/or gas may be introduced from the liquid supply system 140 and/or the gas supply system 150 to a front surface WF of the wafer W, thereby providing a lifting force against the wafer. Through the configuration, the pressure between the wafer W and the polishing pad 120 may be controlled by the force exerted on a back surface WB of the wafer W by the carrier arm 132 and the lifting force created by the gas or liquid on the front surface WF of the wafer W, which in turn will result in precise pressure control during the CMP process and the wafer dechunking.

Figure 1B:
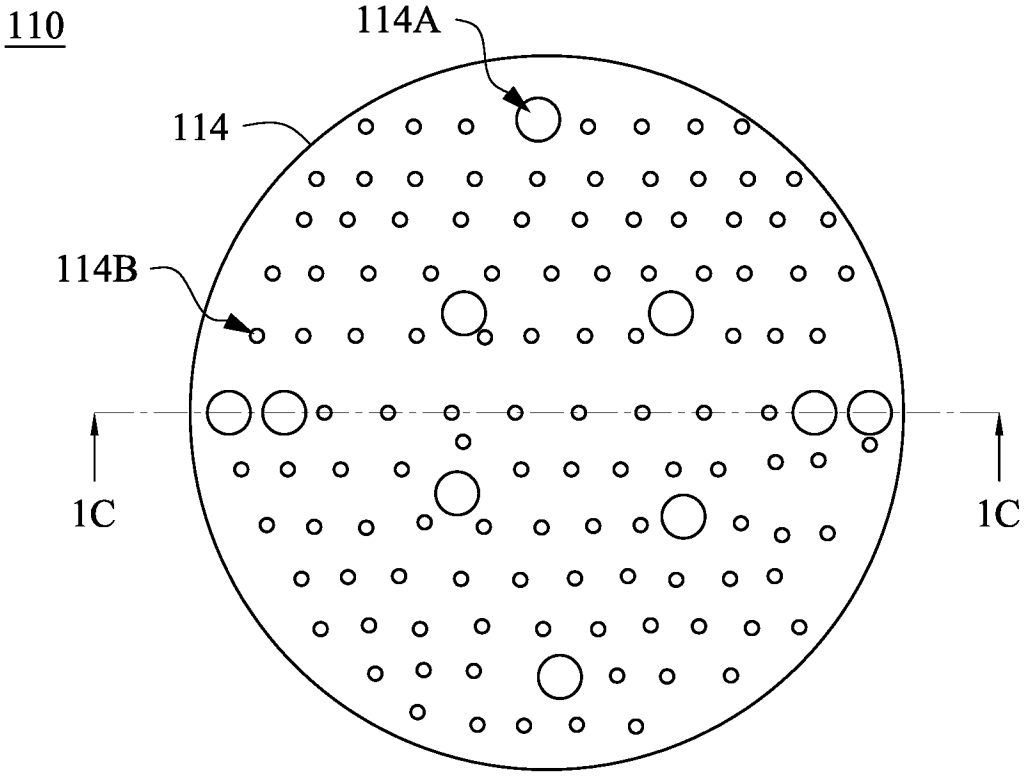
FIG. 1B is a schematic top view of a platen of the CMP apparatus of FIG. 1A.

FIG. 1B is a schematic top view of the platen 114 of the CMP apparatus 100 of FIG. 1A. The platen 114 may include plural holes 114A and 114B, and the liquid supply system 140 and the gas supply system 150 may dispense the liquid and the gas through the holes 114A and 114B, respectively. The liquid supply system 140 may not dispense the liquid and the gas through the holes 114B, and the gas supply system 150 may not dispense the gas through the holes 114A. In some embodiments, since the holes 114A and 114B are used for introducing the liquid and gas, respectively, sizes of the holes 114A and 114B may be different. For example, an opening diameter of each of the holes 114B is smaller than an opening diameter of each of the holes 114A. The opening diameter of each of the holes 114A may be in a range from 10 to 20 millimeters. If the opening diameter of the holes 114A is greater than 20 millimeter, the slurry flow rate may be too large to control, which may cause slurry waste; if the opening diameter of the holes 114A is less than 10 millimeters, the slurry may be dispensed with a large pressure, which may cause defect (ex: corrosion) on wafer surface. The opening diameter of each of the holes 114B may be in a range from 5 to 15 millimeters. If the opening diameter of the holes 114B is greater than the 15 millimeters, the gas flow rate may be too small to create suitable lifting force to the wafer; if the opening diameter of the holes 114B is less than 5 millimeters, the gas flow rate may be too large to control, and the gas dispensed two holes 114B may differ greatly in flow rates even the gas dispensed two holes 114B are determined to have the same flow rates (e.g., by being controlled by the same gas flow regulator), which may result in unstable lifting force to the wafer. In some embodiments, sizes of the holes 114A may be the same or different. The holes 114A may be arranged in an uneven or uniform distribution. In some embodiments, sizes of the holes 114B may be the same or different. The holes 114B may be arranged in an uneven or uniform distribution.

Figure 1C:
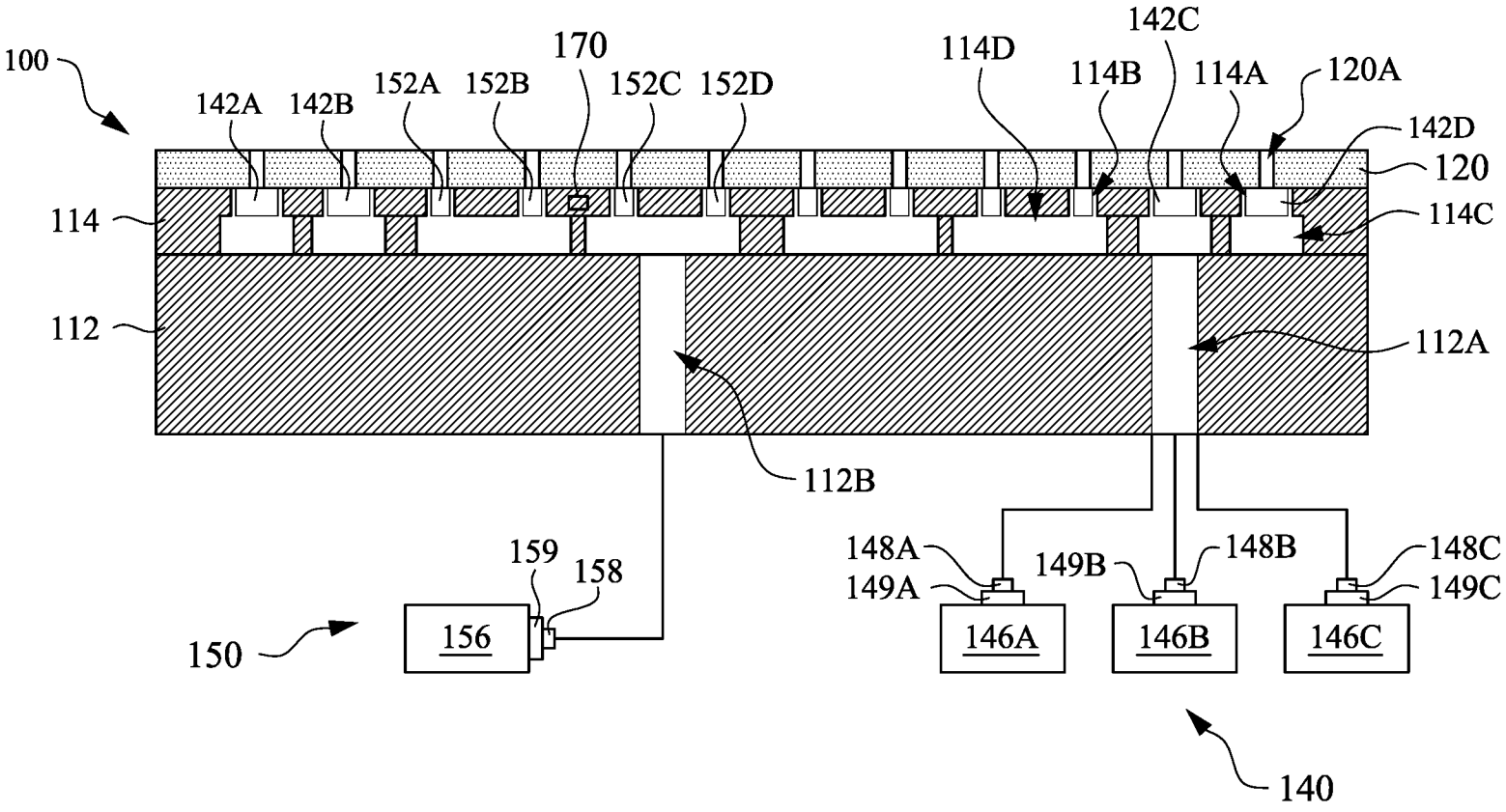
FIG. 1C is a cross-sectional view taken along line 1C-1C of FIG. 1B.

FIG. 1C is a cross-sectional view taken along line 1C-1C of FIG. 1B. The holes 114A and 114B are drilled in the platen 114, and passages 114C and 114D are drilled in the platen 114, in which the passages 114C and 114D are connected with the holes 114A and 114B, respectively. A base 112 may support the platen, and passages 112A and 112B are drilled in the base 112 and connected with the passages 114C and 114D, respectively. The base 112 and the platen 114 may be made of suitable material that is inert to the liquid provided by the liquid supply system 140. For example, the base 112 and the platen 114 may be made of stainless steel, Teflon, or the like. In a CMP process, the platen 114 may be driven by a motor (not shown) in the base 112, while the base 112 remains static, thereby moving the polish pad 120 against the wafer W, thus the wafer W is polished by the polish pad 120.

At least a portion of the liquid supply system 140 and at least a portion of the gas supply system 150 are accommodated in the platen 114. For example, the liquid supply system 140 and the gas supply system 150 may include conduits, valves, or ejectors in the holes 114A and 114B and the passages 114C, 114D, 112A and 112B. As shown in the figure, the liquid supply system 140 may include plural liquid valves 142A-142D in the holes 114A, and the liquid valves 142A-142D are electrically connected to the controller 160 (referring to FIG. 1A). Through the configuration, using the controller 160, the liquid valves 142A-142D can control the liquid (e.g., the slurry, cleaning agent, and water) with different flow rates according to the device requirements and the recipe body.

The polishing pad 120 may a consumable item used in a semiconductor wafer fabrication process. The polishing pad 20 may be a hard, incompressible pad or a soft pad. For oxide polishing, hard and stiffer pads are used to achieve planarity. Softer pads made of resilient material may be used in some polishing processes to achieve improved uniformity and smooth surface. For example, the polish pad 120 may be made of resin or polymer, such as polyurethane. The hard pads and the soft pads may also be combined in an arrangement of stacked pads for customized applications. In some other embodiments, the polish pad 120 is made of suitable breathable/porous materials (e.g., Gore-Tex) that allows gases passing through themselves. In some embodiments, the polish pad 120 may include plural holes 120A for allowing the liquid from the liquid supply system 140 and the gas from the gas supply system 150 passing through themselves. The holes 120A of the polish pad 120 is designed corresponding to the holes 114A and 114B of the platen 114. For example, as shown in figure, the holes 120A of the polish pad 120 are vertically aligned with respect to the holes 114A and 114B of the platen 114.

The liquid is stored in liquid sources 146A, 146B, or 146C and delivered to the holes 114A through the passages 112A and 114C. For better illustration, herein, a liquid source containing slurry is depicted as the source 146A, a liquid source containing cleaning agent is depicted as the source 146B, a liquid source containing water is depicted as the source 146C. For example, slurry, cleaning agent, and water may be respectively stored in the liquid sources 146A, 146B, and 146C and delivered to the holes 114A in a sequence. To be specific, the slurry is provided through the holes 114A during a CMP process, the cleaning agent may be provided through the holes 114A after the CMP process, and water may be provided through the holes 114A after providing the cleaning agent. In some embodiments, the liquid source 146A, 146B, 146C is out of the platen 114.

In some embodiments, the liquid supply system 140 further includes flow sensors 148A, 148B, and 148C and flow regulators 149A, 149B, and 149C connected between the passages 112B and the liquid source 146A, 146B, 146C. The flow sensor 148A, 148B, and 148C is configured to detect a flow rate of the slurry, cleaning agent, and water, respectively. The flow regulator 149A, 149B, and 149C is configured to individually control a flow rate of the slurry, cleaning agent, and water, respectively. For example, the flow regulator 149A, 149B, and 149C may include plural valves. The flow sensors 148A, 148B, and 148C and the flow regulators 149A, 149B, and 149C may be electrically connected to the controller 160, which may perform a feedback closed-loop control to provide a stable liquid pressure. For example, a liquid flow rate/pressure detected by the flow sensor 148A, 148B, and 148C is then feedback to the flow regulator 149A, 149B, and 149C to achieve close loop control. In some other embodiments, the liquid valves 142A-142D may be omitted, and plural flow regulators 149A, plural flow regulators 149B, and plural flow regulators 149C are used to control the flow rates of the slurry, cleaning agent, and water at plural regions.

Through the configuration, the liquid may reach the top frictional surface 120T of the polish pad 120. For example, during CMP process, as shown in FIGS. 1A and 1C, the slurry may flow through the holes 114A of the platen 114 and the holes 120A of the polish pad 120 to an interface or a space between the wafer W and the polish pad 120, thereby react with the front surface WF of the wafer W. The introduction of the slurry offers a lifting force to control a CMP pressure between the wafer W and the polish pad 120. In some embodiments, after the CMP process, the introduction of the slurry offers a lifting force to push the wafer W away from the polish pad 120, thereby facilitating wafer dechunking. In some other examples, after CMP process, the chemical agent and/or water may flow through the holes 114A of the platen 114 and the holes 120A of the polish pad 120 to the top frictional surface 120T of the polish pad 120, and thereby removing away residue slurry from the top frictional surface 120T of the polish pad 120.

In some embodiments, referring to FIG. 1A, the liquid supply system 140 may further include a nozzle 147 above the platen 114, the nozzle 147 may provide a liquid LS (e.g., the slurry, cleaning agent, and water) onto the surface 120T. In some embodiments, the nozzle 147 is connected to a liquid source (e.g., the liquid source 146A, 146B, and 146C as shown in FIG. 1C) through the conduit (not shown), such that the liquid stored in the liquid source 146A, 146B, and 146C may also be delivered to the nozzle 147 through the conduit. The liquid LS (e.g., the slurry, cleaning agent, and water) provided by the nozzle 147 may be the same as the liquid (e.g., the slurry, cleaning agent, and water) introduced from the liquid valves 142. In some other embodiments, the slurry provided by the nozzle 147 may different from the slurry introduced from the liquid valves 142. In some other embodiments, the nozzle 147 may be omitted.

Referring to FIG. 1C, the gas supply system 150 may include plural gas valves 152A-152D and a gas source 156 connected to the passage 112B. The gas valves 152A-152D may be in the holes 114B of the platen 114, and the gas valves 152A-152D may be electrically connected to the controller 160. The gas is stored in the gas source 156 and delivered to the holes 114B through the passages 112B and 114D. Using the controller, the gas valves 152A-152D can control a gas flow rate locally according to the device requirements and the recipe body. In some embodiments, the gas flow rate of the gas introduced from the gas valves 152A may be different from that of the gas valves 152B according to the device requirements and the recipe body. The gas may be an inert gas or other gas that does not react with the liquid provided by the liquid supply system 140. In some embodiments, the carrier gas may be a gas that is substantially free of potential reactants, such as carbon dioxide. For example, the gas may include a clean dry air (CDA), nitrogen, or other suitable gases. In some embodiments, plural groups of the gas valves 152A-152D are connected by plural passages 114D, respectively. For example, herein the gas valves 152A and 152B are grouped and connected by one passages 114D, and the gas valves 152C and 152D are grouped and connected by another passages 114D.

In some embodiments, the gas supply system 150 further include a flow sensor 158 and a flow regulator 159 connected to the passage 112B. The flow sensor 158 is configured to detect a flow rate of the gas. The flow regulator 159 is configured to control a flow rate of the gas. For example, the flow regulator 159 may be a valve. The flow sensor 158 and the flow regulator 159 may be electrically connected to the controller 160, which may perform a closed-loop control to provide a stable gas pressure. For example, a gas flow rate/pressure detected by the flow sensor is then feedback to the flow regulator to achieve close loop control. In some embodiments, the gas valves 152A-152D may be omitted, and plural flow regulators 159 may be used to control the flow rate of the gas at plural regions.

Through the configuration, the gas may flow through the holes 114B of the platen 114 and the holes 120A of the polish pad 120 to an interface or a space between the wafer W and the polish pad 120. For example, during CMP process, the introduction of the gas offers a lifting force to control a CMP pressure between the wafer W and the polish pad 120. In some other examples, after CMP process, the introduction of the gas offers a lifting force to move the wafer W away from the polish pad 120, thereby facilitating wafer dechunking.

In some embodiments, the endpoint module 170 may be used for determining the CMP endpoint of the planarization process by detect a device profile, (e.g., detecting the absorption of the incident light by the surface layer). In some embodiments, the endpoint module 170 is electrically connected with the controller 160 (referring to FIG. 1A). The controller 160 may analyze the device profile detected by the endpoint module 170, and control the liquid valves 142A-142D and the flow regulator 149A, 149B, and 149C of the liquid supply system 140 and the gas valve 152A-152D and the flow regulator 159 of the gas supply system 150 to provide liquid and gases with suitable gas/liquid flows at various positions according to the analysis result. In some embodiments, the liquid flow sensor 148A, 148B, and 148C and the gas flow sensor 158 detects the flow rates, send one or more signals of the liquid/gas flow rates to the controller 160, and the controller 160 control the liquid valves 142A-142D and the flow regulator 149A, 149B, and 149C of the liquid supply system 140 and the gas valve 152A-152D and the flow regulator 159 of the gas supply system 150 to adjusting the liquid/gas flow rates based on the signals.

Figure 2A:
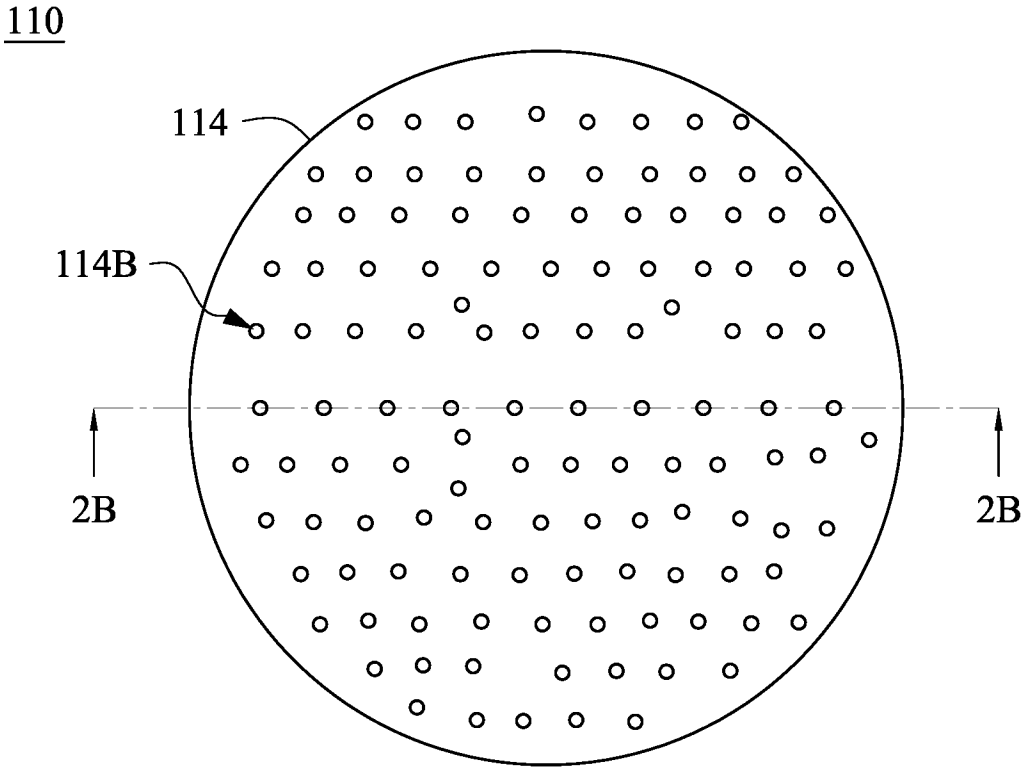
FIG. 2A is a schematic top view of a platen of a CMP apparatus according to some embodiments of the present disclosure.
Figure 2B:
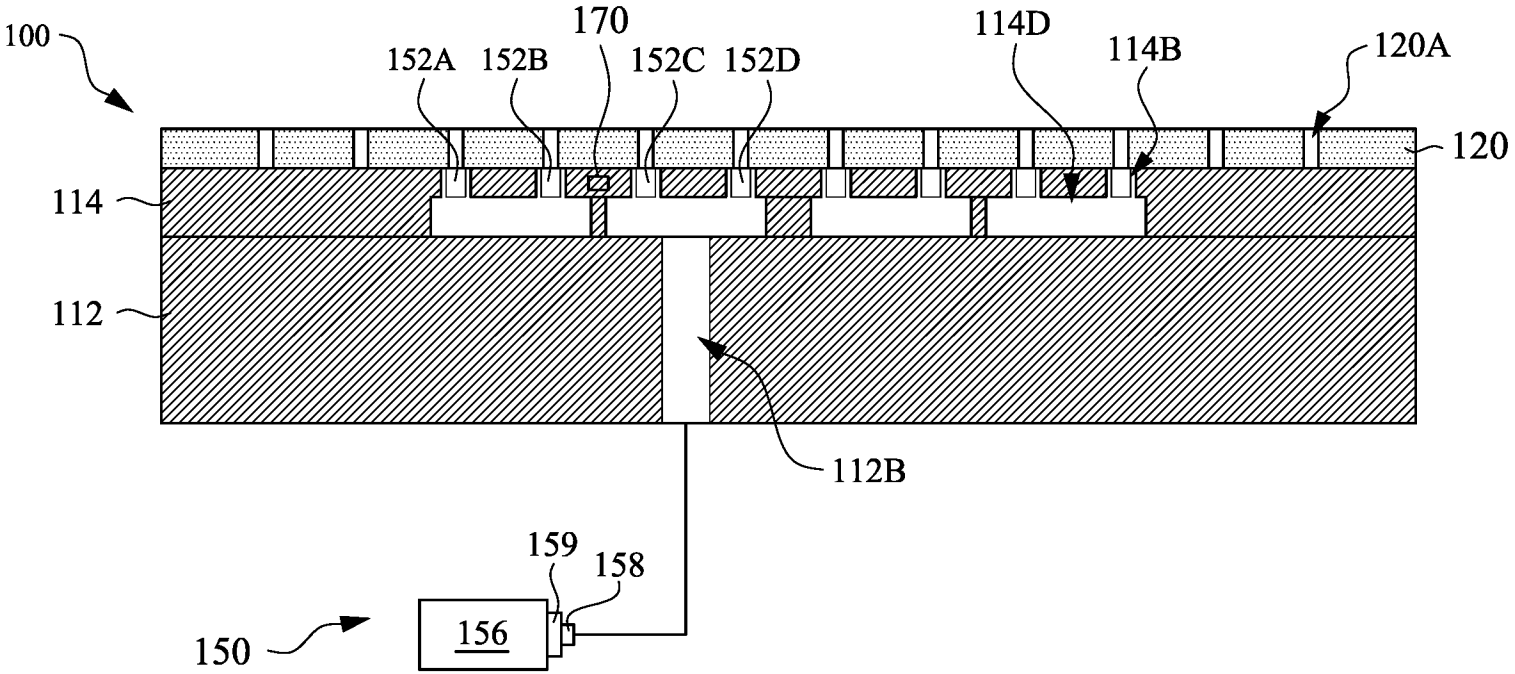
FIG. 2B is a cross-sectional view taken along line 2B-2B of FIG. 2A.

FIG. 2A is a schematic top view of a platen 114 of a CMP apparatus 100 according to some embodiments of the present disclosure. FIG. 2B is a cross-sectional view taken along line 2B-2B of FIG. 2A. The present embodiments are similar to those of the embodiments of FIG. 1B-1C. The difference between the present embodiments and the embodiments of FIG. 1B-1C is that the liquid supply system 140 is omitted herein. As aforementioned, gases may be introduced by the gas supply system 150 through the holes 114B of the platen 114 and the holes 120A of the polish pad 120 to an interface or a space between the wafer W and the polish pad 120. The flow regulator 159, the flow sensor 158, and the gas source 156 of the gas supply system 150 are shown in the figure. Other details of the present embodiments are similar to those of FIGS. 1B-1C, and not repeated.

Figure 3A:
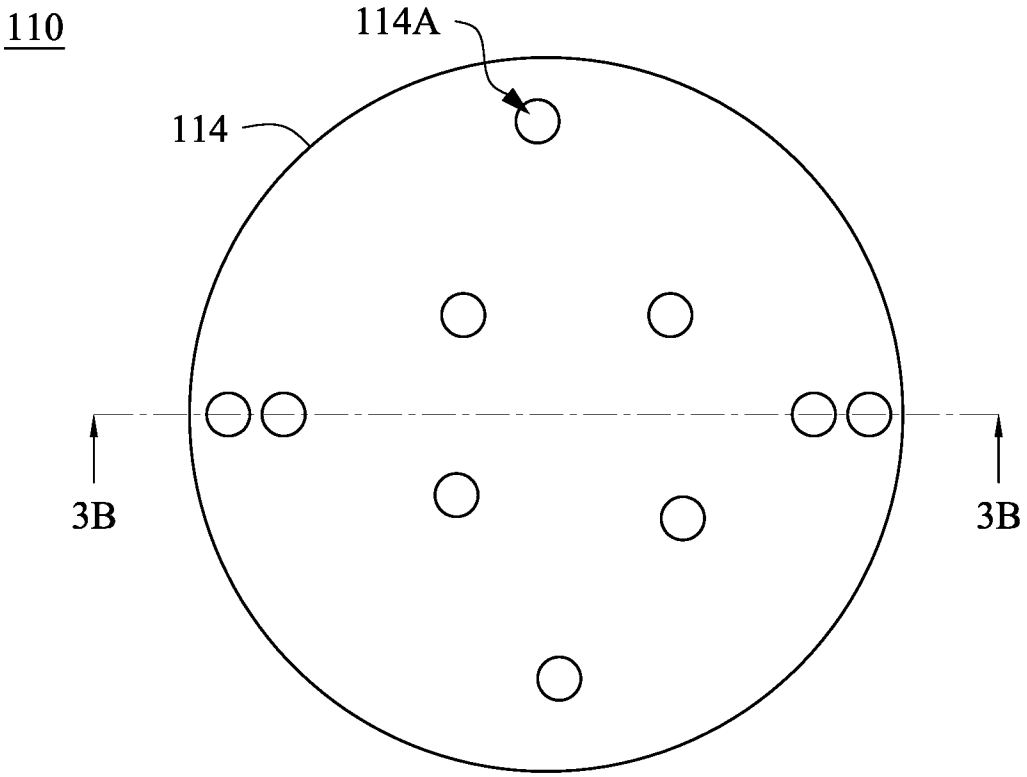
FIG. 3A is a schematic top view of a platen of a CMP apparatus according to some embodiments of the present disclosure.
Figure 3B:
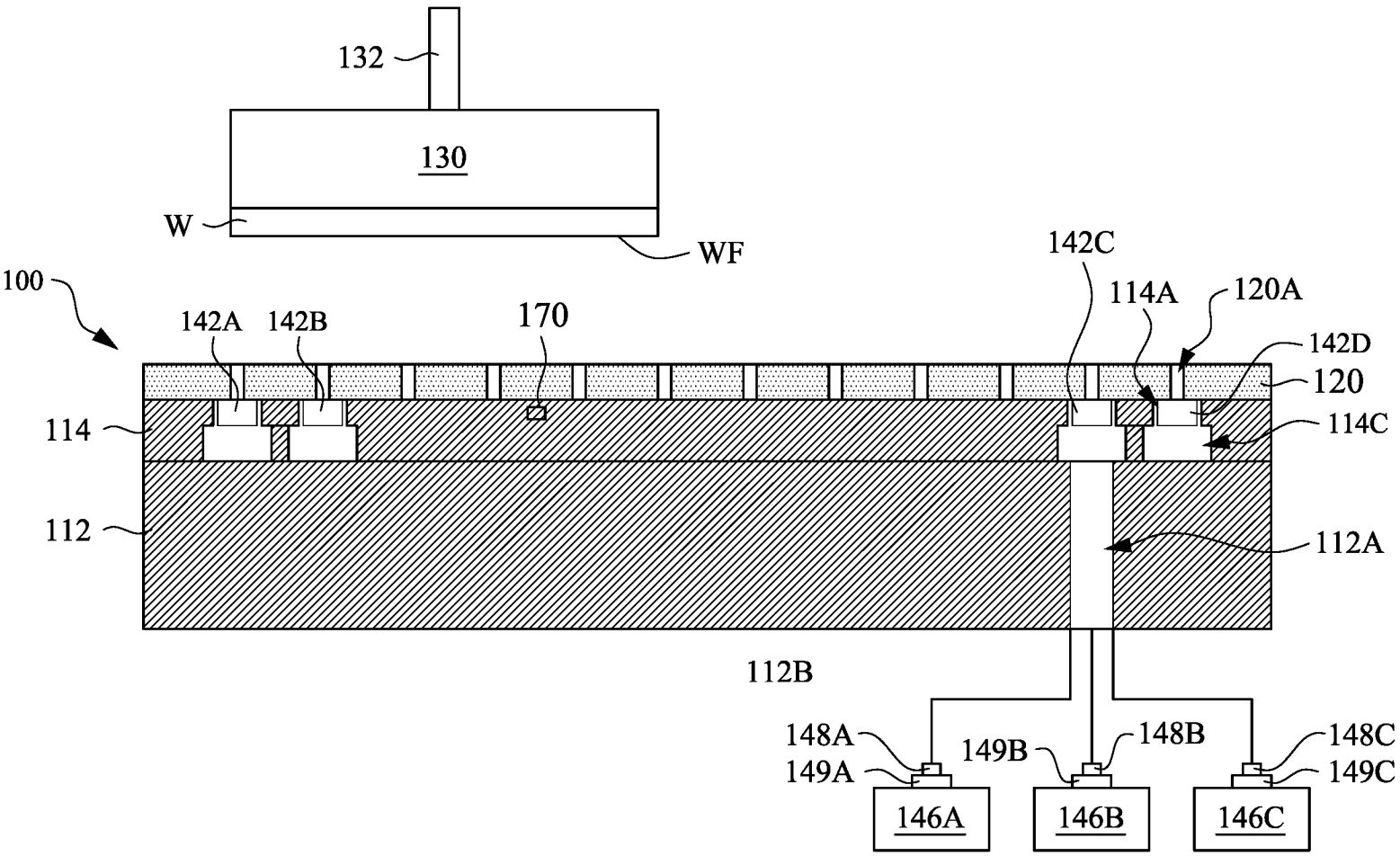
FIG. 3B is a cross-sectional view taken along line 3B-3B of FIG. 3A.

FIG. 3A is a schematic top view of a platen 114 of a CMP apparatus 100 according to some embodiments of the present disclosure. FIG. 3B is a cross-sectional view taken along line 3B-3B of FIG. 3A. The present embodiments are similar to those of the embodiments of FIG. 1B-1C. The difference between the present embodiments and the embodiments of FIG. 1B-1C is that the gas supply system 150 is omitted herein. As aforementioned, liquids may be introduced by the liquid supply system 140 through the holes 114A of the platen 114 and the holes 120A of the polish pad 120 to an interface or a space between the wafer W (referring to FIG. 1A) and the polish pad 120. Other details of the present embodiments are similar to those of FIGS. 1B-1C, and not repeated.

Figure 4:
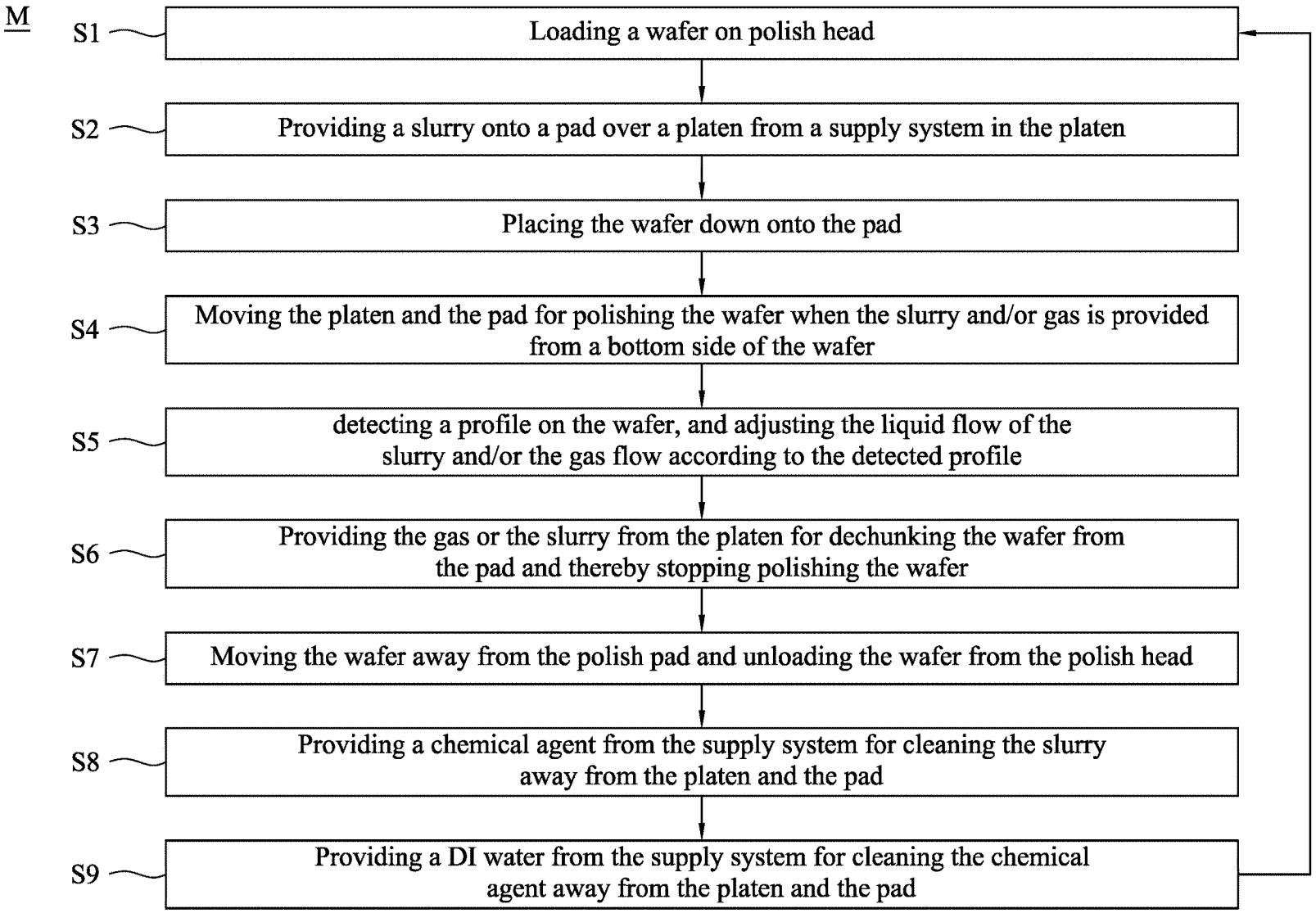
FIG. 4 is a flow chart of a CMP method according to some embodiments of the present disclosure.

FIG. 4 is a flow chart of a CMP method M according to some embodiments of the present disclosure. FIG. 5A-5F illustrates a CMP method M at various stages in accordance with some embodiments. The method M includes steps S1-S9, in which the CMP apparatus 100 in FIGS. 1A-1C is exemplarily used herein. The illustration is merely exemplary and is not intended to limit beyond what is specifically recited in the claims that follow. It is understood that additional operations may be provided before, during, and after the steps shown by FIG. 4, and some of the steps described below can be replaced or eliminated for additional embodiments of the method. The order of the operations/processes may be interchangeable.

Figure 5A:
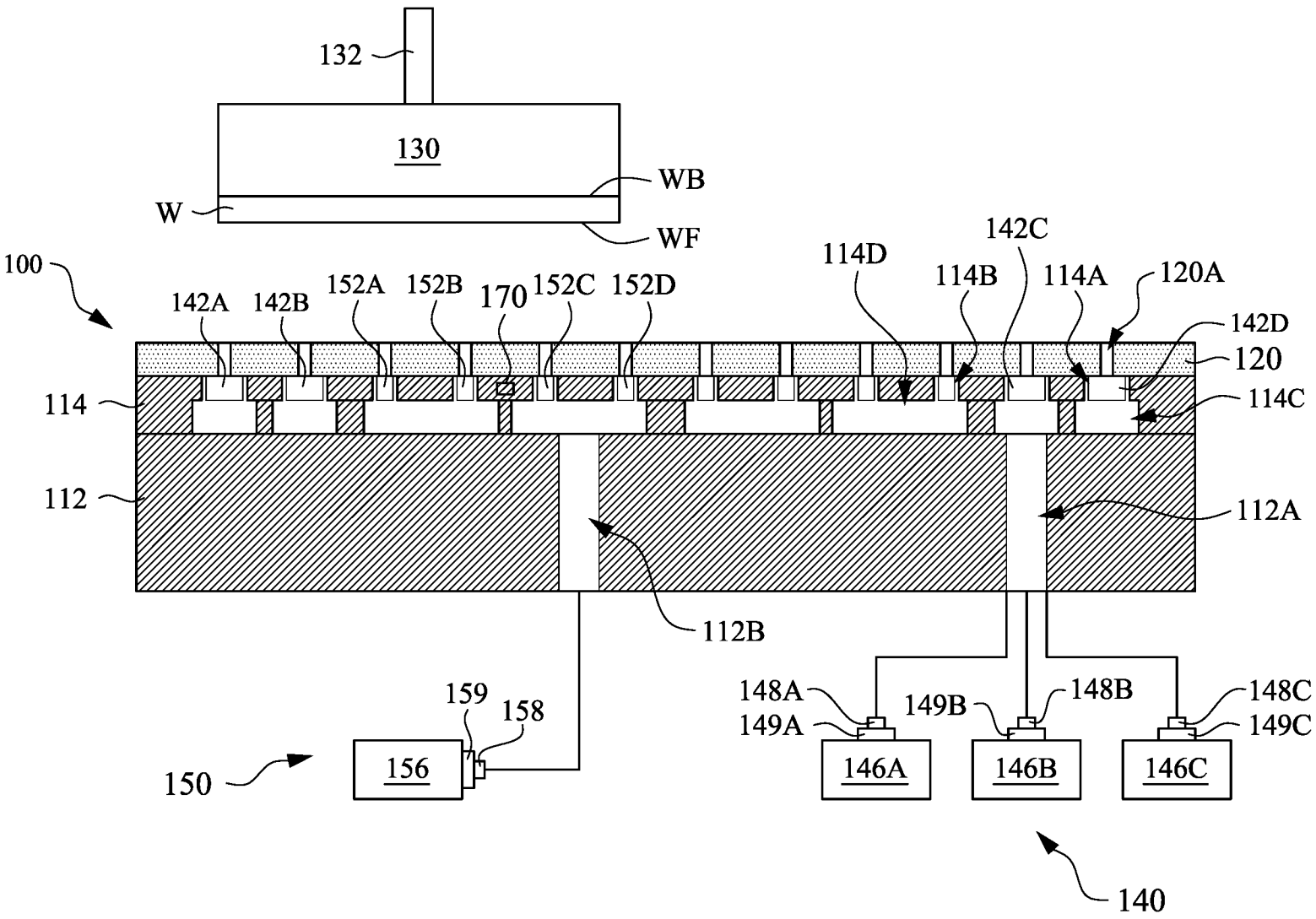
FIGS. 5A-5F illustrate a CMP method at various stages in accordance with some embodiments.

Reference is made to FIGS. 4 and 5A. The method M begins at step S1, where a wafer W is loaded on the polish head 130, in which the wafer W has a front side WF faces downwards and a back side WB faces upwards herein. As aforementioned, the polish head 130 may have suitable vacuum system to hold the wafer W upside down.

Figure 5B:
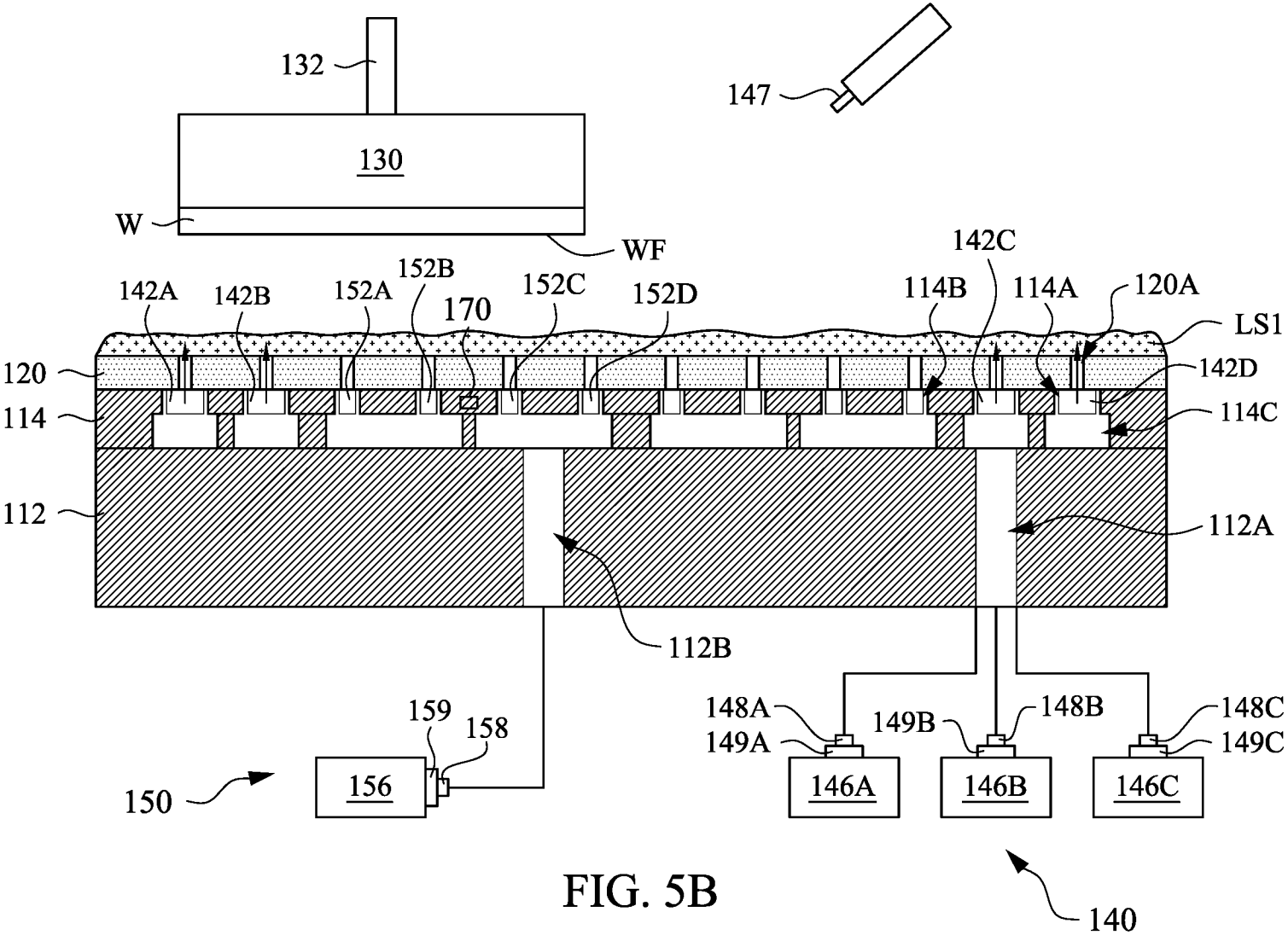

Reference is made to FIGS. 4 and 5B. The method M proceeds to step S2 where a slurry LS1 is provided to a polish pad 120 over a platen 114 from the liquid supply system 140, which is partially in the platen. For example, the slurry LS1 stored in the source 146A is supplied to the holes 114A through the passage 112A and 114C, and the liquid valves 142A-142D of the liquid supply system 140 allows the slurry LS1 passing through the holes 114A, and reaching a bottom side of the polish pad 120. To be specific, the flow regulator 149A may be turned on for introducing the slurry, and the flow regulator 149B and 149C are turned off for stopping the introduction of cleaning agent or water from the sources 146B and 146C. Then, the slurry LS1 flows through the holes 120A of the polish pad 120, from the bottom side of the polish pad 120 to a top side of the polish pad 120. In some embodiments, the slurry LS1 is capable of chemically reacting with a target layer of the wafer W, and produce an easily polished layer. Such slurry LS1 may contain some active polishing ingredients such as abrasive particles. The abrasive particles are made of titanium oxide, silicon oxide or cerium oxide, ferric nitrate, peroxide, potassium iodate, ammonia, silica, and/or alumina, or other suitable materials. In some embodiments, the slurry LS1 may be provided from the nozzle 147 out of the platen 114.

Figure 5C:
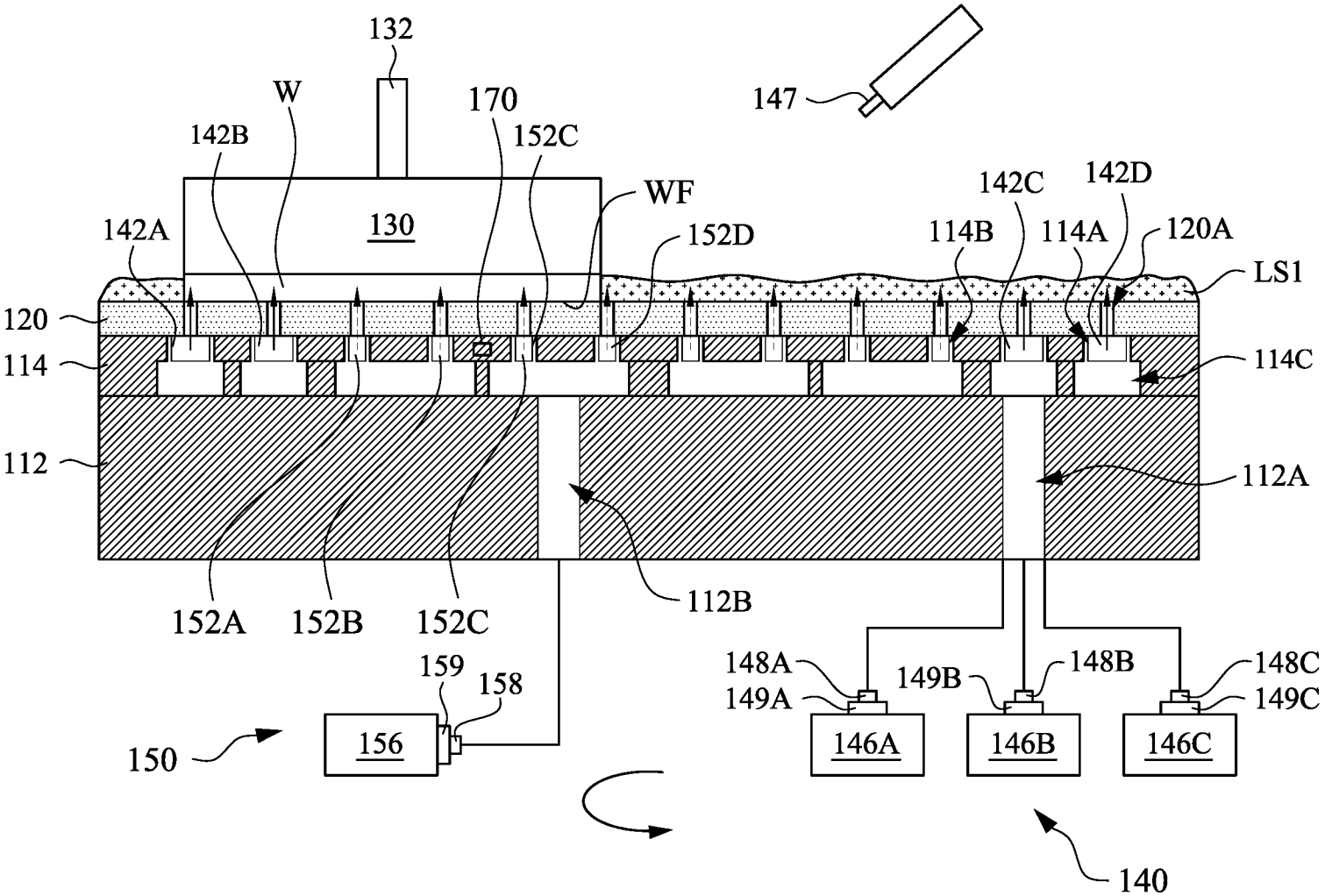

Reference is made to FIGS. 4 and 5C. The method M proceeds to step S3 where the wafer W is pressed down onto the polish pad 120, and the front surface WF of the wafer W is in contact with the slurry LS1 and the polish pad 120 with a suitable pressure. Furthermore, the method proceeds to step S4 where the platen 114 and the polish pad 120 are moved (e.g., relatively rotated) for polishing the wafer W. It is noted that the rotation speeds of the wafer W and the polish pad 120 and the relative pressure between the wafer W and the polish pad 120 determine the rate of polishing or material removal from the wafer surface, and are factors that affect the polishing result, i.e., the planarization of the semiconductor wafer W. Herein, the polish head 130 and the carrier arm 132 connected to the polish head 130 is pressed downwardly against the polishing pad 120 at a predetermined force, thereby controlling the pressure between the wafer W and the polish pad 120. For example, the polish head 130 and the carrier arm 132 moved mechanically up and down for adjusting the pressure. In some cases, an adhesion force between the wafer W and the polish pad 120 may have an impact on the mechanical movement of the polish head 130, and the mechanical movement of the polish head 130 may not be satisfactory for precisely control the pressure therebetween due to the presence of the adhesion force.

In some embodiments of the present disclosure, the slurry LS1 may be introduced into an interface or a space between the wafer W and the polish pad 120 through the liquid valve 142A and 142B when polishing the wafer W, such that the adhesion force between the wafer W and the polish pad 120 is reduced. For example, the wafer W may be held directly on the liquid valves 142A and 142B of the liquid supply system 140. That is, the valves 142A and 142B of the liquid supply system 140 are located in a portion of the platen 114 under the wafer W. As such, the pressure between the wafer W and the polish pad 120 may be precisely controlled by suitably adjusting forces on the polish head 130, adjusting the liquid flow provided by the liquid supply system 140, which will result in a desirable polishing rate on the wafer W.

Similarly, the gas may be introduced into an interface or a space between the wafer W and the polish pad 120 through the gas valves 152A-152D when polishing the wafer W, such that the adhesion force between the wafer W and the polish pad 120 is reduced. For example, the wafer W may be held directly on the gas valves 152A-152C of the gas supply system 150. That is, the gas valves 152A-152C of the gas supply system 150 are located in a portion of the platen 114 under the wafer W. As such, the pressure between the wafer W and the polish pad 120 may be precisely controlled by suitably adjusting forces on the polish head 130, adjusting the liquid flow provided by the liquid supply system 140, and adjusting the gas flow provided by the gas supply system 150, which will result in a desirable polishing rate on the wafer W.

Still referring to FIGS. 4 and 5C. The method M proceeds to step S5 where the endpoint module 170 may detect a device profile on the wafer, and the liquid flow and/or the gas flow may be locally adjusted according to the detected profile during CMP process. For example, if the device profile shows a first portion of a film on the wafer W is thicker than a second portion of the film on the wafer W, the liquid flow at a position of the platen 114 adjacent to the first portion of the wafer W may be increased, and the liquid flow at a position of the platen adjacent to a second portion of the wafer W may be decreased. For example, a flow rate of the slurry LS1 dispensed from the valve 142A near wafer edge may be adjusted to be different from a flow rate of the slurry LS1 dispensed from the valve 142B near wafer center according to the detected profile. That is, the flow rate of the slurry LS1 introduced through a first hole of a platen 114 is greater than the flow rate of the slurry introduced through a second hole of the platen 114. Similarly, a flow rate of the gas dispensed from the gas valve 152A near wafer center may be adjusted to be different from a flow rate of the gas dispensed from the gas valve 152C near wafer edge according to the detected profile.

Figure 5D:
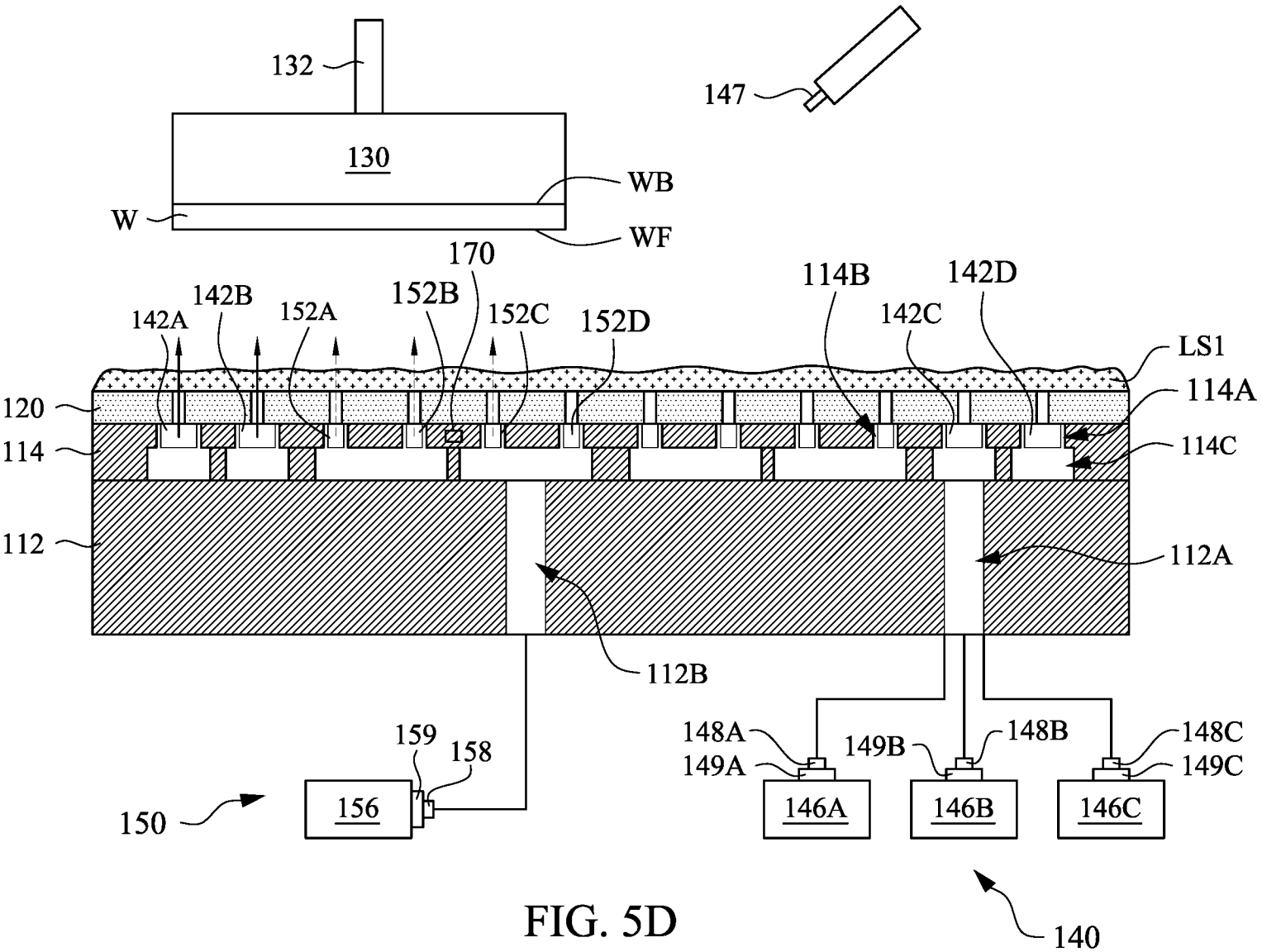

Reference is made to FIGS. 4 and 5D. The method M proceeds to step S6 where the gas and/or the slurry is provided from the platen 114 for dechunking the wafer W from the polish pad 120 and thereby stopping polishing the wafer W. In some embodiments, the gas flow rate for dechunking the wafer W is greater than the gas flow rate used in CMP process (e.g., steps S4 and S5). In some embodiments, the slurry flow rate for dechunking the wafer W is greater than the slurry flow rate used in CMP process (e.g., steps S4 and S5). For example, gases and/or the slurry are introduced to an interface or a space between the wafer W and the polish pad 120, thereby moving the wafer W away from the polish pad 120. Furthermore, the gas and/or the slurry provides a lifting force against the wafer W, such that the wafer W may be moved upward by the force exerted on the back surface WB of the wafer W by the carrier arm and the lifting force created by the gas and/or the slurry on the front surface WF of the wafer W.

In the present embodiments, the gases and/or the slurry for dechunking the wafer W may be provided locally. For example, the gas valves 152A-152C may turn on to allow the gas flows through the corresponding holes 114B but the gas valve 152D may not allow the gas flows through the corresponding holes 114B when dechunking the wafer. In other words, a flow rate of the gas through the gas valves 152A-152C may be adjusted to be greater than a flow rate of the gas through the gas valve 152D when dechunking the wafer.

Similarly, the liquid valves 142A and 142B may allow the slurry flows through the corresponding holes 114A but the liquid valves 142C and 142D may not allow the slurry flows through the corresponding holes 114A when dechunking the wafer. In other words, a flow rate of the slurry through the liquid valves 142A and 142B may be adjusted to be greater than a flow rate of the slurry through the liquid valves 142C and 142D when dechunking the wafer. Still referring to FIGS. 4 and 5D, the method proceeds to step S7 where the wafer W is moved upward away from the polish pad 120. Then, the wafer W may be unloaded from the polish head 130.

Figure 5E:
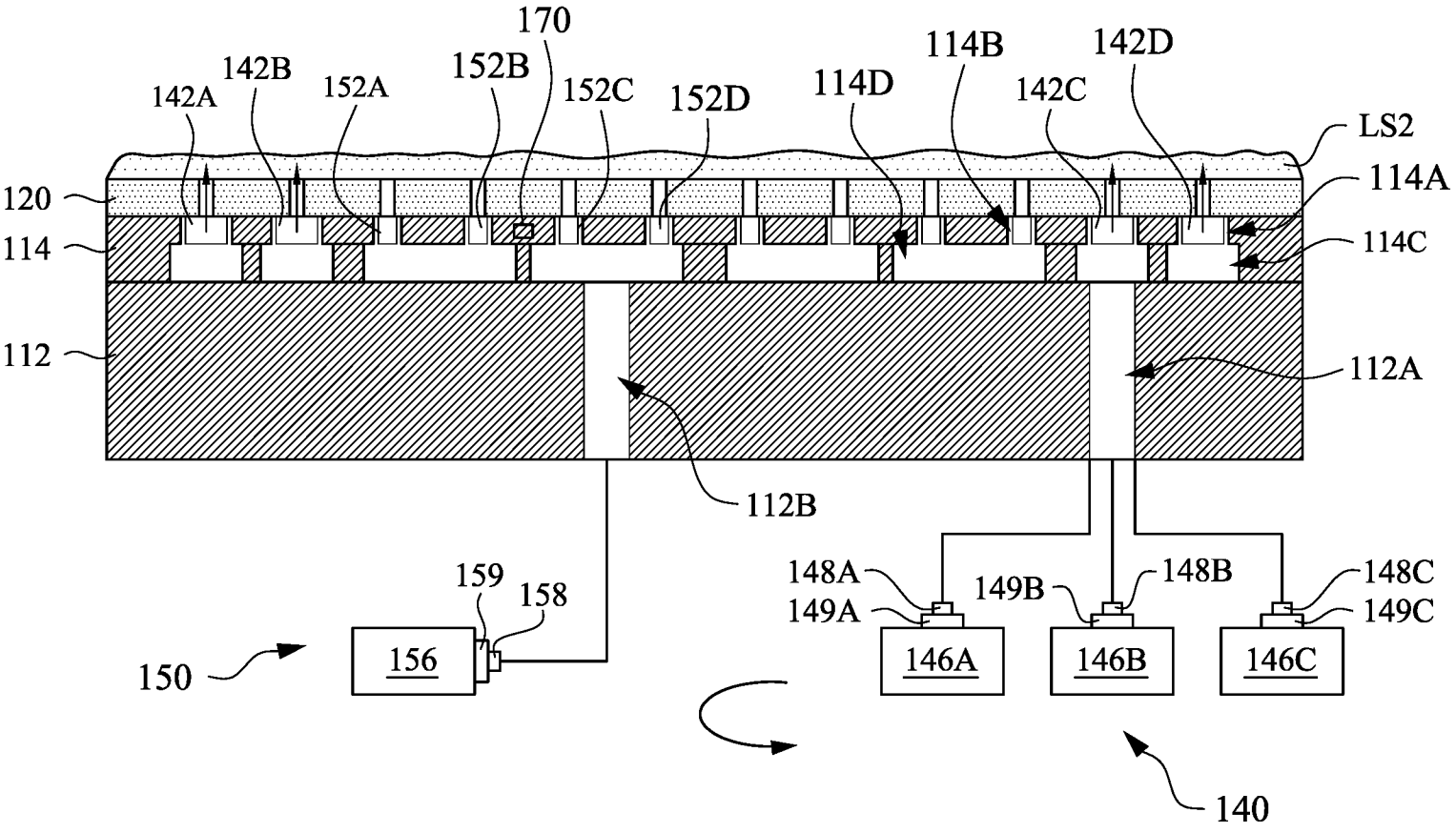

Reference is made to FIGS. 4 and 5E. The method proceeds to step S8 where a cleaning agent LS2 stored in the source 146B is delivered to the liquid valves 142A-142D through the passage 112A and 114C, and the liquid valves 142A-142D allows the cleaning agent LS2 flows to the top surface of the polish pad 120 for removing the slurry LS1 (referring to FIG. 5D) away from the platen 114 and the polish pad 120, thereby realizing a cleaning process. To be specific, herein, the flow regulator 149B is turned on for introducing the cleaning agent LS2, and the flow regulators 149A and 149C are turned off for stopping the introduction of the slurry and wafer. The cleaning agent LS2 may include suitable chemicals, such as citric acid, KOH, or hydrogen peroxide. In some embodiments, the platen 114 may rotate during the cleaning process for accelerating the flow of the cleaning agent LS2.

Figure 5F:
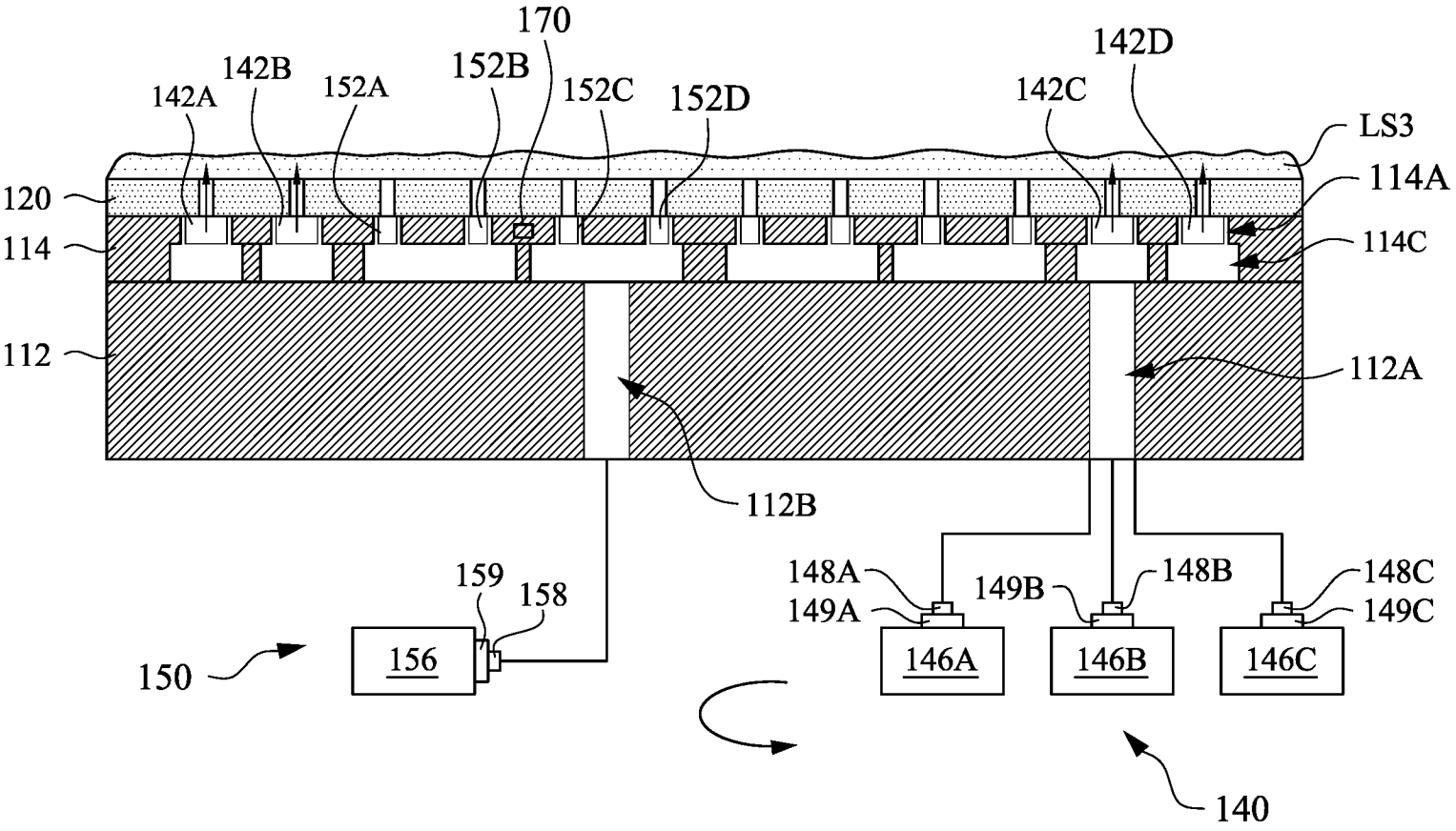

Reference is made to FIGS. 4 and 5F. The method proceeds to step S9 where another cleaning agent LS3 stored in the source 146C is delivered to the liquid valves 142A-142D through the passage 112B and 114D, such that the liquid valves 142A-142D allows the cleaning agent LS3 flows to the top surface of the polish pad 120 for removing the cleaning agent LS2 away from the platen 114 and the polish pad 120. To be specific, herein, the flow regulator 149C is turned on for introducing the cleaning agent LS3, and the flow regulators 149A and 149B are turned off for stopping the introduction of the slurry and cleaning agent in FIG. 5E. The cleaning agent LS3 may include de-ionized wafer, ozone, or HF. In some embodiments, the platen 114 may rotate during the cleaning process for accelerating the flow of the cleaning agent LS3.

Based on the above discussions, it can be seen that the present disclosure offers advantages. It is understood, however, that other embodiments may offer additional advantages, and not all advantages are necessarily disclosed herein, and that no particular advantage is required for all embodiments. One advantage is that a pressure between the wafer and the pad can be controlled by a force applied on a front side of the wafer during CMP process. Another advantage is that a force applied on a front side of the wafer can be used in wafer dechunking. Still another advantage is that the pressure between the wafer and the pad during CMP process can be locally controlled according to the device requirements and the recipe body. Still another advantage is that a slurry for CMP process can be locally controlled according to the device requirements and the recipe body.

According to some embodiments of the present disclosure, a chemical-mechanical polishing method is provided. The chemical-mechanical polishing method includes placing a wafer onto a top side of a polish pad disposed on a platen; introducing a slurry through at least one first hole of the platen to the top side of the polish pad; and polishing the wafer with the top side of the polish pad; introducing a gas through a second hole of the platen to the top side of the polish pad after polishing the wafer, wherein an opening diameter of the at least one first hole is greater than an opening diameter of the second hole; and moving the wafer away from the polish pad while introducing the gas is being performed.

According to some embodiments of the present disclosure, a chemical-mechanical polishing method is provided. The chemical-mechanical polishing method includes placing a wafer onto a top side of a polish pad disposed on a platen; introducing a slurry through a plurality of first holes of the platen to the top side of the polish pad; polishing the wafer with the top side of the polish pad; detecting, by an endpoint module, a profile of the wafer during polishing the wafer; and performing a feedback close loop control, by a controller, for adjusting a flow rate of the slurry through the first holes of the platen according to the detected profile of the wafer during polishing the wafer.

According to some embodiments of the present disclosure, a chemical-mechanical polishing system includes a platen, a polish pad, a polish head, a gas source, and a slurry source. The platen has a plurality of first holes and a plurality of second holes. The polish pad is supported by the platen, and the polishing pad has a plurality of holes communicating with the first holes and the second holes of the platen. The polish head is disposed above the polish pad for pressing a wafer on the polish pad. The gas source is out of the platen and fluidly connected with the first holes of the platen. The slurry source is out of the platen and fluidly connected with the second holes of the platen.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A chemical-mechanical polishing method, comprising:

placing a wafer onto a top side of a polish pad disposed on a platen;

introducing a slurry through at least one first hole of the platen to the top side of the polish pad;

polishing the wafer with the top side of the polish pad;

introducing a gas through a second hole of the platen to the top side of the polish pad after polishing the wafer, wherein an opening diameter of the at least one first hole is greater than an opening diameter of the second hole; and moving the wafer away from the polish pad while introducing the gas is being performed.

2. The chemical-mechanical polishing method of claim 1, wherein introducing the slurry is performed while polishing the wafer is being performed.

3. The chemical-mechanical polishing method of claim 1, wherein introducing the slurry is performed after polishing the wafer.

4. The chemical-mechanical polishing method of claim 1, further comprising introducing a cleaning agent through the at least one first hole of the platen to the top side of the polish pad after moving the wafer away from the polish pad.

5. The chemical-mechanical polishing method of claim 1, wherein introducing the slurry is performed such that the slurry is introduced through a hole of the polish pad.

6. The chemical-mechanical polishing method of claim 1, wherein introducing the gas is performed such that the gas is introduced through a hole of the polish pad.

7. The chemical-mechanical polishing method of claim 1, wherein introducing the slurry is performed such that the slurry is not introduced through the second hole of the platen.

8. The chemical-mechanical polishing method of claim 1, wherein introducing the gas is performed such that the gas is not introduced through the at least one first hole of the platen.

9. The chemical-mechanical polishing method of claim 1, wherein a flow rate of the slurry introduced through one of a plurality of the first holes of the platen is greater than a flow rate of the slurry introduced through another one of the first holes of the platen.

10. The chemical-mechanical polishing method of claim 1, further comprising:

detecting, using an endpoint module, a profile of the wafer during polishing the wafer; and adjusting, using a controller, a flow rate of the slurry according to the detected profile of the wafer during polishing the wafer.

11. A chemical-mechanical polishing system, comprising:

a platen having a plurality of first holes and a plurality of second holes, wherein an opening diameter of each of the first holes is smaller than an opening diameter of each of the second holes;

a polish pad supported by the platen, the polishing pad having a plurality of holes communicating with the first holes and the second holes of the platen;

a polish head disposed above the polish pad for pressing a wafer on the polish pad;

a gas source outside of the platen and fluidly connected with the first holes of the platen; and a slurry source outside of the platen and fluidly connected with the second holes of the platen.

12. The chemical-mechanical polishing system of claim 11, further comprising:

a liquid valve in the second holes of the platen; and a controller connected with the liquid valve for controlling slurry flowing through the second holes.

13. The chemical-mechanical polishing system of claim 12, further comprising:

an endpoint module configured to detect a profile of the wafer, wherein the endpoint module is electrically connected with the controller such that the controller performs a feedback close loop control for adjusting the slurry flowing through the second holes according to the detected profile of the wafer.

14. The chemical-mechanical polishing system of claim 11, further comprising:

a cleaning agent source outside of the platen and fluidly connected with the second holes of the platen.

15. The chemical-mechanical polishing system of claim 11, wherein the polish pad is made of a porous material allowing gas to pass through the polish pad.

16. The chemical-mechanical polishing system of claim 11, wherein an inert gas is stored in the slurry source.

17. A chemical-mechanical polishing method, comprising:

polishing a side of a wafer with a polish pad, wherein the polish pad has at least one hole therein;

introducing a gas to the side of the wafer through the at least one hole of the polish pad after polishing the side of the wafer; and moving the wafer away from the polish pad while introducing the gas is being performed.

18. The chemical-mechanical polishing method of claim 17, further comprises:

introducing a liquid to the side of the wafer through the at least one hole of the polish pad while moving the wafer away from the polish pad.

19. The chemical-mechanical polishing method of claim 17, further comprises:

introducing a slurry to the side of the wafer through the polish pad while polishing the side of the wafer with the polish pad.

20. The chemical-mechanical polishing method of claim 17, wherein the polish pad has a plurality of the holes therein, and introducing the gas is performed such that the gas is introduced to the side of the wafer through the holes of the polish pad, and a flow rate of the gas through a first one of the holes of the polish pad is greater than a flow rate of the gas through a second one of the holes of the polish pad.

* * * * *